US005242232A

United States Patent [19]

Kuhn

[11] Patent Number: 5,242,232

[45] Date of Patent: Sep. 7, 1993

[54] ANTI-DRIP APPLICATOR

[75] Inventor: Petrus H. A. N. Kuhn, Den Haag, Netherlands

[73] Assignee: Sara Lee/DE N.V., Den Haag, Netherlands

[21] Appl. No.: 805,998

[22] Filed: Dec. 9, 1991

[30] Foreign Application Priority Data

Dec. 10, 1990 [NL] Netherlands ..... 9002709

[51] Int. Cl.[5] ..... A47L 23/05

[52] U.S. Cl. ..... 401/122; 401/130

[58] Field of Search ..... 401/122, 130, 126

[56] References Cited

U.S. PATENT DOCUMENTS

| | | | |
|---|---|---|---|
| 520,343 | 5/1894 | Thomas | 401/130 |
| 610,103 | 8/1898 | Taylor | 401/122 X |
| 3,494,702 | 2/1970 | Aston | 401/122 |
| 3,951,157 | 4/1976 | Idec | 401/130 X |
| 3,957,066 | 5/1976 | Dahm | 401/122 X |
| 4,175,574 | 11/1979 | Zulberti | 401/122 |
| 4,403,624 | 9/1983 | Montgomery | 401/122 X |

FOREIGN PATENT DOCUMENTS

| | | | |
|---|---|---|---|
| 380182 | 1/1990 | European Pat. Off. . | |
| 484518 | 10/1929 | Fed. Rep. of Germany . | |
| 852439 | 10/1952 | Fed. Rep. of Germany | 401/122 |
| 2722232 | 11/1978 | Fed. Rep. of Germany . | |
| 2256739 | 8/1975 | France . | |
| 574232 | 4/1976 | Switzerland | 401/130 |

*Primary Examiner*—Steven A. Bratlie

*Attorney, Agent, or Firm*—Merchant, Gould, Smith, Edell, Welter & Schmidt

[57] ABSTRACT

A dispenser for liquid material, such as shoe polish, comprising a container (1) and an applicator (2) by means of which a small quantity of the material (P) can be removed from the container (1) by dipping and then applied to a surface to be treated with the material (P). In this dispenser the applicator (2) has a length relative to the height of the container (1) such that in the inserted position of the applicator (2) the spongy applicator end (16) is at least partially compressed against the container bottom. A tube (5) is arranged in the container (1), which tube (5) extends from the mouth of the container (1) down into the vicinity of the bottom thereof. At least the lower end of the tube (5) forms a proper fit for an applicator (2) inserted therein and the space within the tube (5) communicates through at least one passage with the annular container space around the tube (5). At least one scraping ring (7) having open passages (10) communicating with the annular container space for the applicator (2) is arranged at the top of the tube (5). The applicator (2) consists of a cylindrical portion (15) which is only slightly narrower than the tube (5) and a spongy end (16).

8 Claims, 2 Drawing Sheets

ANTI-DRIP APPLICATOR

BACKGROUND OF THE INVENTION

This invention relates to a dispenser for liquid material, such as shoe polish, comprising a container and an applicator by means of which a small quantity of the material can be removed from the container by dipping and applied to the surface to be treated with the material.

Although the invention can be applied in many fields, for instance in the field of cosmetics, it will be described herein with particular reference to its application as a shoe polish dispenser.

A drawback of shoe polish dispensers of the above described type is that when the applicator is being removed from the container for a first application of the material or after dipping it into the opened container, an uncontrollable amount of liquid material can adhere to the applicator allowing for the spillage excess liquid, which is naturally undesirable. An associated problem is that when a material-absorbing end of an applicator is dipped into a mass of liquid material, it is difficult to absorb a controlled small amount of the material, for instance a small amount of shoe polish for spreading it on a shoe surface. A further problem is that after some time the applicator will dry out owing to evaporation.

Applicant's earlier European patent application No. 90200168.4 discloses a dispenser for liquid material, comprising a container and an applicator by means of which a small quantity of the material can be removed from the container by dipping and then applied to a desired surface. In one embodiment, the dispenser comprises a tube extending from the mouth of the container into the vicinity of the bottom thereof, at least the lower end of this tube forming a proper fit for an applicator inserted into the tube. This tube communicates only at the lower end thereof with the otherwise closed, annular container space around the tube, so that in accordance with the principle of the Torricellian tube, always only such an amount of liquid material is supplied from the closed annular space through the passage adjacent the bottom to the inner space of the tube, that a hydrostatic equilibrium is reached with a low liquid level in the inner space of the tube and a much higher level in the closed annular space where a subatmospheric pressure prevails above the liquid. Each time an amount of liquid has been removed from the tube by the applicator such that air can flow into the annular space, the tube is replenished from the annular space up to the original, low level. This means that by inserting the applicator into the tube to a given depth, defined for instance by a stop, the material-absorbing end of the applicator is always dipped into the liquid to the same depth and therefore the same amount of material is withdrawn from the stock.

With that dispenser the objects contemplated are indeed accomplished, namely that each time the material-absorbing end of the applicator is dipped into the mass of liquid material, only a small amount of the material is absorbed, so that spillage, evaporation of the liquid and drying out of the typically spongy applicator are avoided.

However, the above described dispenser works optimally only if the viscosity of the product is exactly matched with the dimensions of the dispenser parts.

The object of the present invention is to provide a dispenser of the type described, the operation of which is not based on the Torricellian principle and which, as a consequence, is more universally applicable, while spillage is avoided in a constructively simple manner, a reasonable control is obtained of the amount of liquid to be absorbed when dipping the applicator, and evaporation of the liquid and drying out of the applicator are avoided.

SUMMARY OF THE INVENTION

To that end, a dispenser for liquid material, such as shoe polish, comprises a container and an applicator by means of which a small quantity of the material can be removed from the container by dipping and applied to a desired surface. A tube is arranged extending from the mouth of the container down into the vicinity of the bottom thereof, at least the lower end of the tube forming a proper fit for an applicator inserted therein. The inner space of tube communicates through at least one passage with the annular container space around the tube, as disclosed in European patent application No. 90200168.4. The dispenser is characterized in that at least one scraping ring for the applicator is arranged at the top of the tube, with open passages communicating with the annular container space being provided at least adjacent the outer circumference of said scraping ring, the tube extends entirely down to the bottom of the container and narrow passages are provided in the tube wall, which passages permit a slow inflow of viscous material, and the applicator consists of a cylindrical portion that is only slightly narrower than the tube and a spongy end and has such a length relative to the height of the container that in the inserted position of the applicator the spongy applicator end is at least partially compressed against the bottom of the holder.

During withdrawal of the applicator from the container, the spongy end thereof expands and absorbs the liquid material present on the outside of the applicator. Because this material can only reach the inner space of the tube through the narrow passages in the tube, the sponge end does not have the opportunity to become entirely saturated with the liquid. The formation of drops at the sponge end is therefore avoided and hence the risk of spillage is reduced. The apertures adjacent the scraping ring serve for the aeration and deaeration of the contents of the container and/or for allowing the material that has been scraped off to flow back into the container.

In further elaboration of the invention, a second scraping ring can be arranged externally of the first scraping ring, the upper edge of this second ring being disposed at a higher level, while apertures communicating with the annular container space are present adjacent the two rings. In that case, the second, higher ring can be used for scraping the sponge before it is applied to the surface to be treated.

The passages in the tube can be of any shape that is acceptable from the point of view of injection moulding technique. They can for instance be narrow slits arranged in circumferentially staggered relationship, each extending over a considerable part of the length of the tube. This can ensure a good, controlled inflow of material from the annular space to the inner space of the tube, without adversely affecting the strength of the tube.

To clarify the invention, one embodiment of the anti-drip applicator will now be described, by way of example, with reference to the accompanying drawings, in which.

Figure 1:
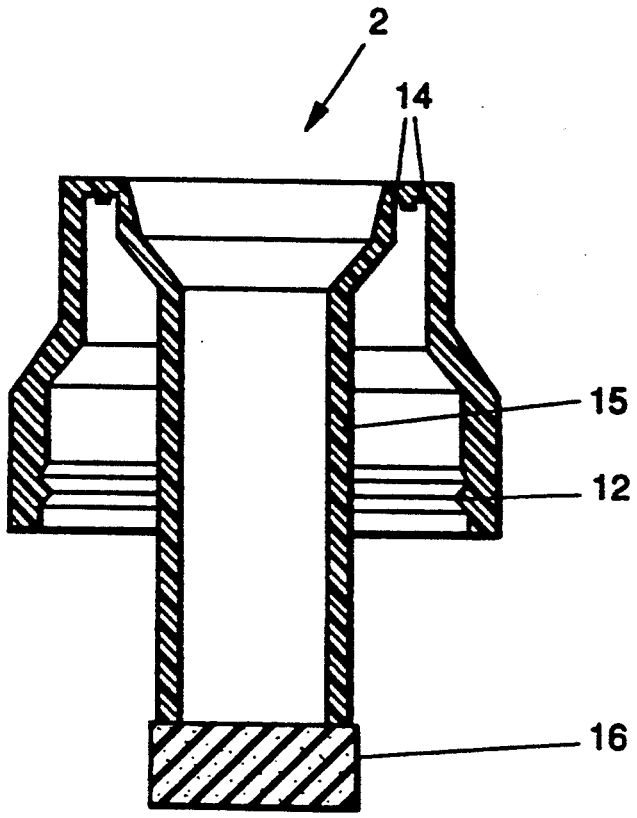
FIG. 1 is a sectional view of the applicator.
Figure 2:
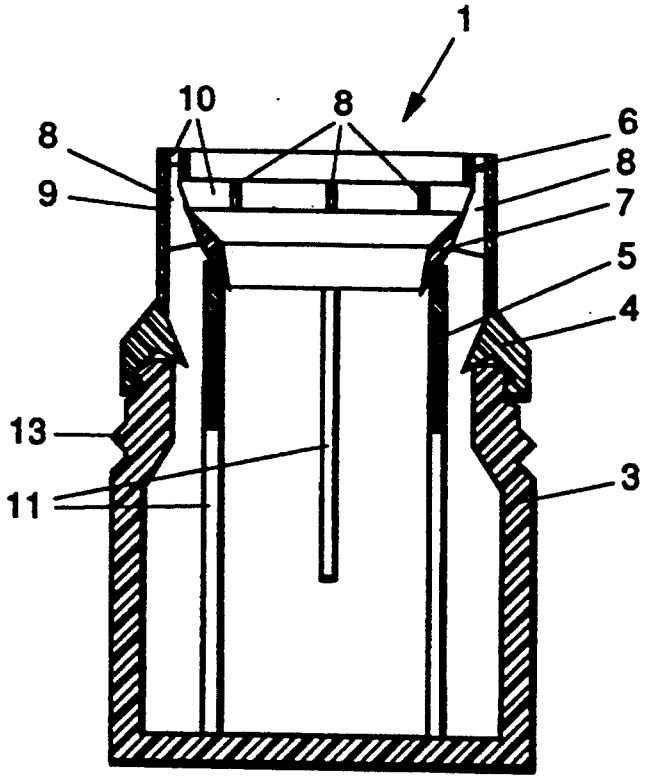
FIG. 2 is a sectional view of the container.
Figure 3:
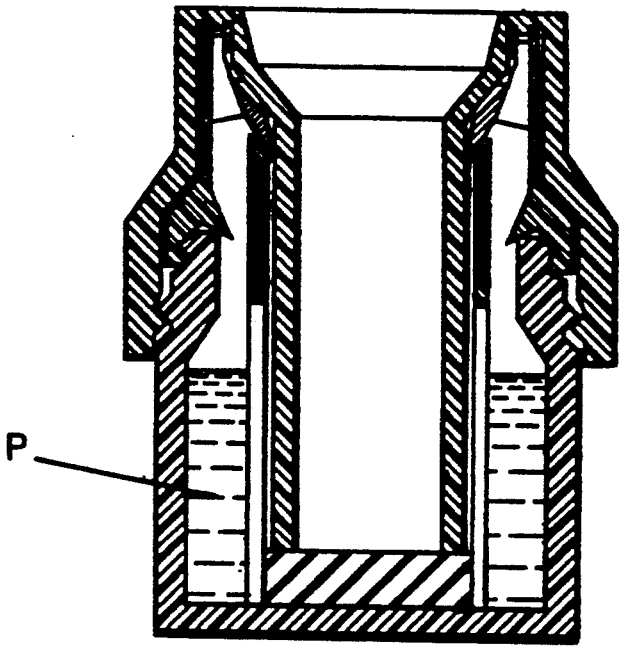
FIG. 3 is a view of the anti-drip applicator in closed position.

The anti-drip applicator of the embodiment shown consists of a container 1 and an applicator 2.

The container 1 consists of a vessel 3, a cap 4 bounding the opening of the vessel and a tube 5. The cap 4 is fixedly mounted on the top of the vessel and comprises an upper scraping ring 6 and a lower scraping ring 7 which are concentrically connected to the inside of the outer wall 9 of the cap 4 by means of ribs 8. Provided between the upper scraping ring 6 and the outer wall 9 and between the lower scraping ring 7 and the upper scraping ring 6 are apertures 10 serving for aeration and de-aeration of the contents of the container and/or for allowing the material P that has been scraped off to flow back into the container 1. The tube 5 is a cylindrical element extending from the lower end of the lower scraping ring 7 down to or approximately down to the bottom of the vessel 3. The tube 5 comprises narrow passages 11 which in this embodiment have the shape of narrow slits 11 arranged in circumferentially staggered relationship, each extending over a considerable part of the length of the tube.

The applicator 2 at the same time forms the cover of the container 1 and in this embodiment comprises internal screw thread 12 engaging with external screw thread 13 of the vessel 3. The applicator 2 comprises closing profiles 14 which abut the outer wall 9 and the upper scraping ring 6 of the cap 4 and seal the container 1. Further, the applicator 2 comprises a cylindrical portion 15 comprising at the lower end thereof a spongy end 16. The cylindrical portion 15 is only slightly narrower than the tube 5 and has such a length relative to the container 1 that in the inserted position of the applicator 2 the spongy end 16 is at least partially compressed against the bottom of the vessel 3.

During withdrawal of the applicator 2 from the container 1, the spongy end 16 thereof expands and absorbs the liquid material P present on the outside of the applicator. As this material P can only enter the tube 5 through the narrow passages 11 in the tube 5, the spongy end 16 does not have the opportunity to become entirely saturated with the liquid P. The formation of drops at the spongy end 16 is thereby avoided and the risk of spillage is reduced. Further, the lower scraping ring 7 scrapes the material P off the circumferential surface of the cylindrical portion 15 and off the circumferential surface of the spongy end 16. The upper scraping ring 6 can be used to scrape material off the bottom of spongy end 16 before this end is applied to the surface to be treated.

It will be clear that the invention is not restricted to the embodiment described, but that various modifications are possible within the framework of the invention.

I claim:

1. A dispenser for liquid material, such as shoe polish, comprising a container (1) having a mouth and bottom, and an applicator (2) by means of which a small quantity of the material (P) can be removed from the container (1) by dipping and applied to a surface to be treated with the material (P), wherein the applicator (2) has such a length relative to the height of the container (1) that in the inserted position of the applicator (2) a spongy applicator end (16) is at least partially compressed against the container bottom and in which dispenser a tube (5) is arranged in the container (1), which tube (5) extends from the mouth entirely down to the bottom of the container (1), the applicator having a cylindrical portion (15) which is only slightly narrower than the tube (5), said tube (5) having a lower end which forms a proper fit for the spongy end of the applicator (2) inserted therein, the tube (5) having an inner space communicating through at least one narrow passage with the annular container space around the tube (5), which narrow passage permits a slow in flow of viscous material (P), the dispenser further comprising at least one scraping ring (7) for the applicator (2), which scraping ring (7) is arranged at the top of the tube (5), with open passages (10) communicating with the annular container space being provided at least adjacent the outer circumference of said scraping ring (7).

2. A dispenser according to claim 1, characterized in that a second scraping ring (6) is provided externally of the first scraping ring (7), the upper edge of said second scraping ring (6) being disposed at a higher level, and passages (10) communicating with the annular container space being present adjacent the two rings (6, 7).

3. A dispenser according to claim 1, characterized in that the narrow passages (11) are in the form of one or more small openings.

4. A dispenser according to claim 1, characterized in that the passages (11) in the tube (5) are in the form of narrow slits (11) arranged in circumferentially staggered relationship, each of said slits (11) extending over a considerable part of the length of the tube.

5. A dispenser according to claim 2, characterized in that the narrow passages (11) are in the form of one or more small openings.

6. A dispenser according to claim 2, characterized in that the passages (11) in the tube (5) are in the form of narrow slits (11) arranged in circumferentially staggered relationship, each of said slits (11) extending over a considerable part of the length of the tube.

7. A dispenser according to claim 3, characterized in that the passages (11) in the tube (5) are in the form of narrow slits (11) arranged in circumferentially staggered relationship, each of said slits (11) extending over a considerable part of the length of the tube.

8. A dispenser according to claim 5, characterized in that the passages (11) in the tube (5) are in the form of narrow slits (11) arranged in circumferentially staggered relationship, each of said slits (11) extending over a considerable part of the length of the tube.

* * * * *